US011350204B2

(12) United States Patent
Ku

(10) Patent No.: US 11,350,204 B2
(45) Date of Patent: May 31, 2022

(54) WEARABLE AUDIO DEVICE FEEDFORWARD INSTABILITY DETECTION

(71) Applicant: Bose Corporation, Framingham, MA (US)

(72) Inventor: Emery M. Ku, Somerville, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/993,619

(22) Filed: Aug. 14, 2020

(65) Prior Publication Data

US 2022/0053260 A1 Feb. 17, 2022

(51) Int. Cl.
*G10K 11/178* (2006.01)
*H04R 1/10* (2006.01)

(52) U.S. Cl.
CPC ..... *H04R 1/1083* (2013.01); *G10K 11/17833* (2018.01); *G10K 11/17873* (2018.01); *G10K 2210/1081* (2013.01); *H04R 2410/01* (2013.01)

(58) Field of Classification Search
None
See application file for complete search history.

(56) References Cited

U.S. PATENT DOCUMENTS 6,608,898 B1 8/2003 Moore et al.
8,155,334 B2 4/2012 Joho et al.
8,494,178 B1 7/2013 Carpenter et al.
9,881,601 B2 1/2018 Barnes et al.
2010/0061564 A1* 3/2010 Clemow ..... G10K 11/17854 381/71.6
2014/0363010 A1* 12/2014 Christopher ..... G10K 11/17885 381/71.6
2017/0110106 A1* 4/2017 Kumar ..... H04R 29/00

OTHER PUBLICATIONS

The International Search Report and the Written Opinion of the International Searching Authority dated Dec. 3, 2021 for PCT Application No. PCT/US2021/046044.

* cited by examiner

*Primary Examiner* — James K Mooney
(74) *Attorney, Agent, or Firm* — Brian M. Dingman; Dingman IP Law, PC

(57) ABSTRACT

A system for detecting feedforward instability in a wearable audio device. The audio device includes an electro-acoustic transducer that is configured to develop sound for a user, a housing that holds the transducer, a feedforward microphone that is configured to detect sound outside of the housing and output a microphone signal, and an opening in the housing that emits sound pressure from the transducer that can reach the microphone. A feedforward instability detector is configured to apply two filters to the microphone signal. A first filter passes more energy in a frequency band than does a second filter, to develop a filtered signal. The filtered signal is compared to the microphone signal outside of the frequency band, to develop a comparison signal that is indicative of feedforward instability in the frequency band.

21 Claims, 8 Drawing Sheets

WEARABLE AUDIO DEVICE FEEDFORWARD INSTABILITY DETECTION

BACKGROUND

This disclosure relates to a wearable audio device.

Wearable audio devices such as earbuds and hearing aids can develop parasitic oscillations in a feedforward loop that can lead to undesirable instability and squealing.

SUMMARY

All examples and features mentioned below can be combined in any technically possible way.

In one aspect a system for detecting feedforward instability in a wearable audio device that comprises an electro-acoustic transducer that is configured to develop sound for a user, a housing that holds the transducer, a feedforward microphone that is configured to detect sound outside of the housing and output a microphone signal, and an opening in the housing that emits sound pressure from the transducer that can reach the microphone, includes a feedforward instability detector that is configured to apply two filters to the microphone signal, wherein a first filter passes more energy in a frequency band than does a second filter to develop a filtered signal and then compare the filtered signal to the microphone signal outside of the frequency band to develop a comparison signal that is indicative of feedforward instability in the frequency band.

Some examples include one of the above and/or below features, or any combination thereof. In an example the wearable audio device comprises an earbud that is configured to output sound directly into the user's ear canal. In an example the feedforward microphone is used in an active noise reduction (ANR) system. In an example the feedforward microphone is used in a transparency mode where environmental sounds are reproduced by the transducer. In an example the first filter comprises a peak filter. In an example the second filter comprises a notch filter. In an example the feedforward instability detector is configured to apply multiple sets of detection and rejection filters at different frequency bands.

Some examples include one of the above and/or below features, or any combination thereof. In an example the first and second filters together detect parasitic oscillations in a predetermined frequency range. In an example the frequency range is centered at approximately 3,100 Hz. In an example the detector is further configured to apply a threshold energy level to the first filter energy. In an example feedforward instability is indicated only if the energy level of the energy passed by the first filter is above the threshold.

Some examples include one of the above and/or below features, or any combination thereof. In an example feedforward instability is indicated when the energy level of the energy passed by the first filter is greater than the energy level of the energy passed by second filter. In some examples feedforward instability is indicated when the energy level of the energy passed by the first filter remains greater than the energy level of the energy passed by second filter for at least a threshold amount of time. In an example feedforward instability is indicated when the energy level of the energy passed by the first filter is greater than the energy level of the energy passed by second filter energy and the microphone signal outside of the frequency band is greater than a signal level threshold, for at least a threshold amount of time.

Some examples include one of the above and/or below features, or any combination thereof. In an example the system further includes an instability mitigator that is configured to adjust a gain applied to the microphone signal. In some examples the gain is reduced for a predetermined amount of time. In an example after the predetermined amount of time the gain is increased back to its original value. In an example the increase in gain occurs gradually over a predetermined period of time. In an example the gain is adjusted in a frequency-dependent manner.

In another aspect a computer program product having a non-transitory computer-readable medium including computer program logic encoded thereon that, when performed on a wearable audio device that comprises an electro-acoustic transducer that is configured to develop sound for a user, a housing that holds the transducer, a feedforward microphone that is configured to detect sound outside of the housing and output a microphone signal, and an opening in the housing that emits sound pressure from the transducer that can reach the microphone, causes the wearable audio device to apply two filters to the microphone signal, wherein a first filter passes more energy in a frequency band than does a second filter to develop a filtered signal, and then compare the filtered signal to the microphone signal outside of the frequency band to develop a comparison signal that is indicative of feedforward instability in the frequency band.

Some examples include one of the above and/or below features, or any combination thereof. In an example the wearable audio device comprises an earbud that is configured to output sound directly into the user's ear canal.

DETAILED DESCRIPTION

Figure 1:
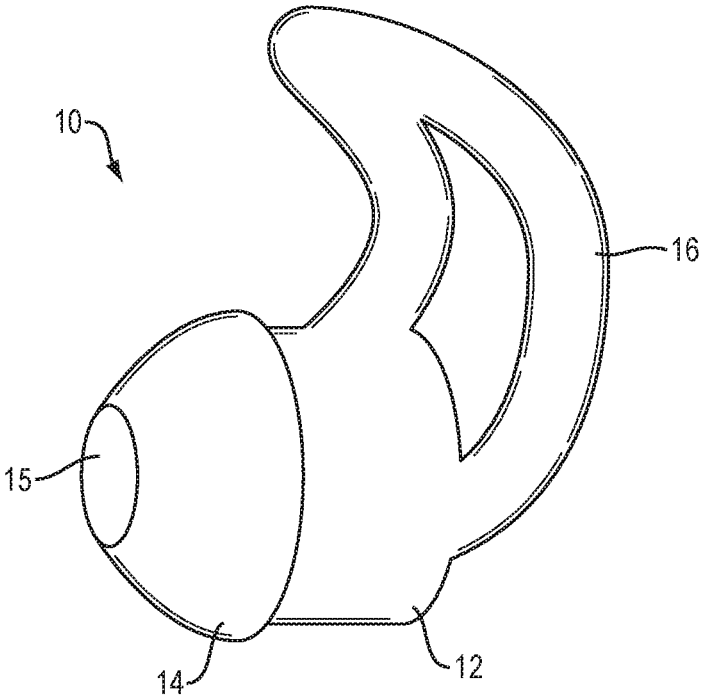
FIG. 1 is perspective view of a wearable audio device.

This disclosure relates to a wearable audio device. Some non-limiting examples of this disclosure describe a type of wearable audio device that is known as an earbud. Earbuds generally include an electro-acoustic transducer for producing sound, and are configured to deliver the sound directly into the user's ear canal. Earbuds can be wireless or wired. In non-limiting examples described herein the earbuds include one or more feedforward (external) microphones that sense external sounds outside of the housing. Feedforward microphones can be used for functions such as active noise reduction (ANR) and transparency mode operation where external sounds are reproduced for the user by the electro-acoustic transducer. Other aspects of earbuds that are not involved in this disclosure are not shown or described.

Some examples of this disclosure also describe a type of wearable audio device that is known as an open audio device. Open audio devices have one or more electro-acoustic transducers (i.e., audio drivers) that are located off of the ear canal opening. In some examples the open audio devices also include one or more microphones; the microphones can be used to pick up the user's voice and/or for ANR and/or for transparency mode operation. Open audio devices are further described in U.S. Pat. No. 10,397,681, the entire disclosure of which is incorporated herein by reference for all purposes.

An open audio device includes but is not limited to an off-ear headphone, i.e., a device that has one or more electro-acoustic transducers that are coupled to the head or ear (typically by a support structure) but do not occlude the ear canal opening. In some examples an open audio device is an off-ear headphone comprising audio eyeglasses, but that is not a limitation of the disclosure as in an open audio device the device is configured to deliver sound to one or both ears of the wearer where there are typically no ear cups and no ear buds. The wearable audio systems contemplated herein may include a variety of devices that include an over-the-ear hook, such as a wireless headset, hearing aid, eyeglasses, a protective hard hat, and other open ear audio devices.

A headphone refers to a device that typically fits around, on, or in an ear and that radiates acoustic energy directly or indirectly into the ear canal. Headphones are sometimes referred to as earphones, earpieces, headsets, earbuds, or sport headphones, and can be wired or wireless. A headphone includes a driver to transduce electrical audio signals to acoustic energy. The driver may or may not be housed in an earcup or in a housing that is configured to be located on the head or on the ear, or to be inserted directly into the user's ear canal. A headphone may be a single stand-alone unit or one of a pair of headphones (each including at least one acoustic driver), one for each ear. A headphone may be connected mechanically to another headphone, for example by a headband and/or by leads that conduct audio signals to an acoustic driver in the headphone. A headphone may include components for wirelessly receiving audio signals. A headphone may include components of an ANR system, which may include an internal microphone within the headphone housing and an external microphone that picks up sound outside the housing. Headphones may also include other functionality, such as additional microphones for an ANR system, or one or more microphones that are used to pick up the user's voice.

One or more of the devices, systems, and methods described herein, in various examples and combinations, may be used in a wide variety of wearable audio devices or systems, including wearable audio devices in various form factors. One such form factor is an earbud. Unless specified otherwise, a wearable audio device or system includes headphones and various other types of wearable audio devices such as head, shoulder or body-worn acoustic devices (e.g., audio eyeglasses or other head-mounted audio devices) that include one more acoustic transducers to receive and/or produce sound, with or without contacting the ears of a user.

It should be noted that although specific implementations of wearable audio devices primarily serving the purpose of acoustically outputting audio are presented with some degree of detail, such presentations of specific implementations are intended to facilitate understanding through provisions of examples and should not be taken as limiting either the scope of the disclosure or the scope of the claim coverage.

In some examples the wearable audio device includes an electro-acoustic transducer that is configured to develop sound for a user, a housing that holds the transducer, a feedforward microphone that is configured to detect sound outside of the housing and output a microphone signal, and an opening in the housing that emits sound pressure from the transducer that can reach the microphone. The processor system is programmed to accomplish a feedforward instability detector functionality that is configured to apply two filters to the feedforward microphone signal, wherein a first filter passes more energy in a frequency band than does a second filter. The filtered signal is compared to the microphone signal outside of the frequency band to develop an indication of feedforward instability in the frequency band.

FIG. 1 is a perspective view of a wireless in-ear earbud 10. An earbud is a non-limiting example of a wearable audio device. Earbud 10 includes body or housing 12 that houses the active components of the earbud. Portion 14 is coupled to body 12 and is pliable so that it can be inserted into the entrance of the ear canal. Sound is delivered through opening 15. Retaining loop 16 is constructed and arranged to be positioned in the outer ear, for example in the antihelix, to help retain the earbud in the ear. Earbuds are well known in the field (e.g., as disclosed in U.S. Pat. No. 9,854,345, the disclosure of which is incorporated herein by reference in its entirety, for all purposes), and so certain details of the earbud are not further described herein.

Figure 2:
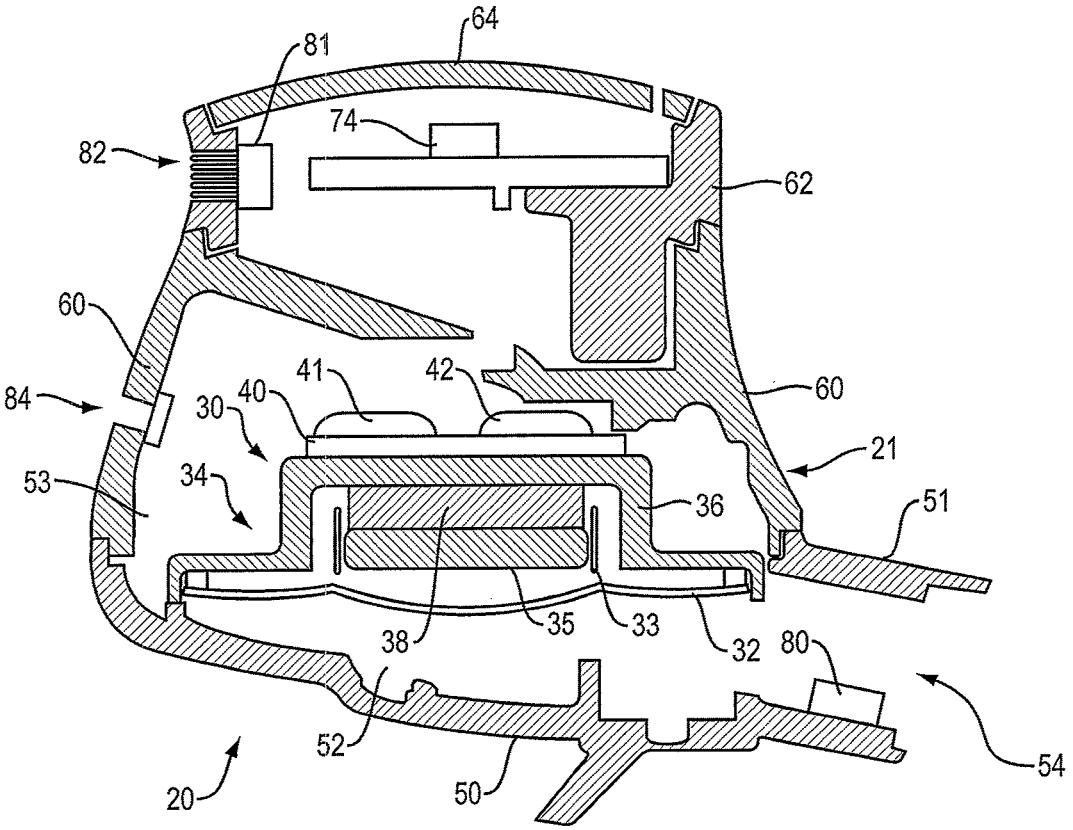
FIG. 2 is a partial cross-sectional view of elements of a wearable audio device.

FIG. 2 is a partial cross-sectional view of only certain elements of an earbud 20 that are useful to a better understanding of the present disclosure. Earbud 20 comprises housing 21 that encloses electro-acoustic transducer (audio driver) 30. Housing 21 comprises front housing portion 50 and rear housing portions 60 and 62. Transducer 30 has diaphragm 32 that is driven in order to create sound pressure in front cavity 52. Sound is also created in rear cavity 53. Sound pressure is directed out of front housing portion 50 via sound outlet 54. Internal microphone 80 is located inside of housing 21. In an example microphone 80 is in sound outlet 54, as shown in FIG. 2. External microphone 81 is configured to sense sound external to housing 21. In an example exterior microphone 81 is located inside of the housing and is acoustically coupled to the external environment via housing openings 82 that let environmental sound reach microphone 81. In an example interior microphone 80 is used as a feedback microphone for active noise reduction, and exterior microphone 81 is used as a feed-forward microphone for active noise reduction, and/or for transparency mode operation where environmental sound is played to the user so the user is more environmentally aware, and can hear others speaking and the like. An earbud, such as shown by earbud 10 in FIG. 1, typically includes a pliable tip (not shown) that is engaged with neck 51 of housing portion 50, to help direct the sound into the ear canal. Earbud housing 21 further comprises a rear enclosure made from rear housing portions 60 and 62, and grille 64. Note that the details of earbud 20 are exemplary of aspects of earphones and are not limiting of the scope of this disclosure, as the present feedforward instability detection can be used in varied types and designs of earbuds and earphones and other types of wearable audio devices.

Transducer 30 further comprises magnetic structure 34. Magnetic structure 34 comprises transducer magnet 38 and magnetic material that functions to confine and guide the magnetic field from magnet 38, so that the field properly interacts with coil 33 to drive diaphragm 32, as is well known in the electro-acoustic transducer field. The magnetic material comprises cup 36 and front plate 35, both of which are preferably made from a material with relatively high magnetic susceptibility, also as is known in the field. Transducer printed circuit board (PCB) 40 carries electrical and electronic components (not shown) that are involved in driving the transducer. Pads 41 and 42 are locations where wires (not shown) can be coupled to PCB 40.

Earbud 20 also includes processor 74. In some examples processor 74 is configured to process outputs of microphones 80 and 81. Of course the processor is typically involved in other processing needed for earbud functionality, such as processing digital sound files that are to be played by the earbud, as would be apparent to one skilled in the technical field. In an example the processor is configured to detect feedforward instability. The processor may also be configured to mitigate instability. In an example feedforward instability can be caused when the feedforward microphone (that is used to sense environmental sounds external to the earbud) picks up sound from the earbud's audio driver, leading to parasitic oscillation. This can happen when acoustic pressure that leaves the housing through resistive port 84 in rear cavity 53 is sensed by microphone 81. Direct coupling through other ports or even leaks in the acoustic cavity can also result in feedforward instability. Resulting feedforward instability can cause oscillations or squealing. Squealing can occur even when the earbud is properly in place in the user's ear. Squealing can also occur when an earbud is placed into its case and is not shut off; this can happen when communication between the earbud and the case is improper, such as when the battery of the case is drained.

In some examples the processor is programmed to apply one or more filters to the signal received from the external microphone, in order to detect feedforward instability. In one example the processor accomplishes a detection filter and a rejection filter that operate in a predefined frequency band. The detection filter will selectively detect energy in a frequency band. The rejection filter will selectively detect energy outside of this same band. The processor can compare the detected in-band energy to energy outside of the same frequency band in order to help reject broadband sounds or impulsive events while still detecting feedforward instability in the frequency band. In some examples the processor applies a threshold to the detection filter in order to help ensure that quiet tonal signals that originate external to the device are not detected as instability. In some examples the processor applies a timer to the detected signal so that short duration in-band sounds are not detected as instability.

The detection and/or rejection filters can take any desired shape across the frequency band. In an example the detection filter is a peak filter and the rejection filter is a notch filter. The peak and notch filters can be configured to be centered at a desired frequency. In one non-limiting example the center frequency is approximately 3,000 Hz. In other examples the notch filter is biased up outside the frequency band of interest, which can assist with the rejection of false positives. A notch that is biased upwards results in energy outside the band of interest being weighted more heavily against the target region. An impulsive event may have equal energy across a wide range of frequencies. If that energy is centered around the target band, it may be detected as a false positive; biasing the rejection band upwards helps mitigate this. In another example the intersections of the two filters (which can be accomplished at about −3 dB) helps to define their combined effect. In another example the filters are a notch filter and a filter that has a flat frequency response across the band of interest.

In other examples the processor is configured to apply multiple sets of detection and rejection filters across different frequency bands or areas of interest. This arrangement can provide greater flexibility in applying more targeted mitigations of oscillations (e.g. narrowband reductions in gain). Benefits of considering more narrowly confined detection regions as well as a corresponding narrowing of the bandwidth of a gain reduction mitigation is that a false positive detection would be less likely as well as less noticeable, respectively.

Figure 3:
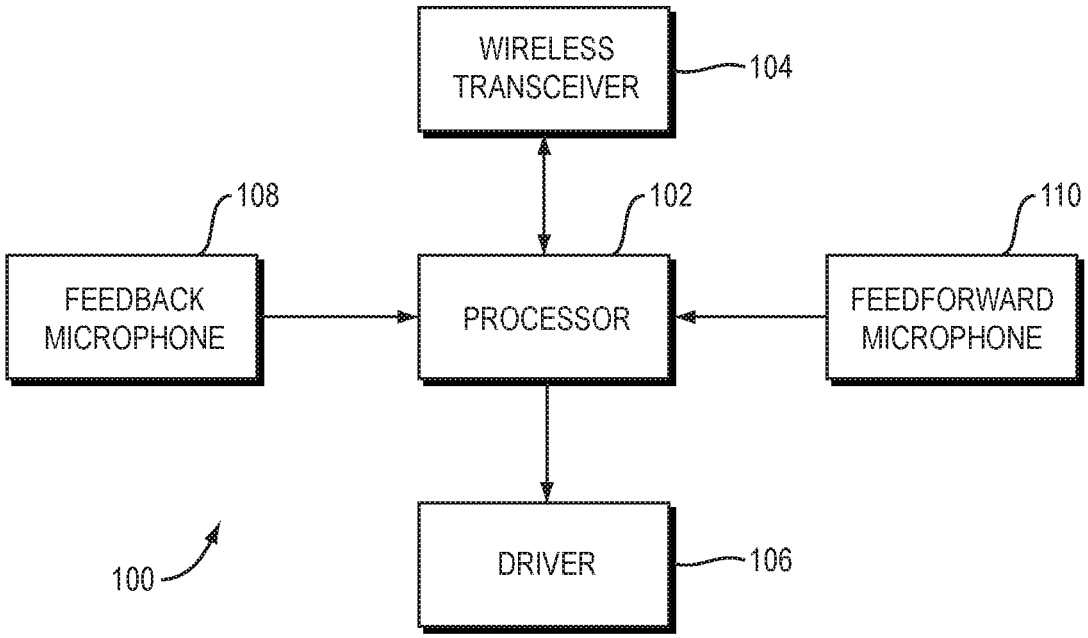
FIG. 3 is a block diagram of aspects of a wearable audio device.

FIG. 3 is a block diagram of aspects of a wearable audio device 100. In an example device 100 is an earbud, but this is not a limitation of the disclosure. Wearable audio device 100 includes processor 102 that receives audio data from external sources via wireless transceiver 104. Processor 102 also receives the outputs of the feedback microphone(s) 108 and the feedforward microphone(s) 110. Processor 102 outputs audio data that is converted into analog signals that are supplied to audio driver 106. In an example device 100 includes memory comprising instructions, which, when executed by the processor, accomplish the filters and other processing described herein that are configured to detect feedforward instability. In some examples the detected instability is also mitigated via the processor. In some examples device 100 is configured to store a computer program product using a non-transitory computer-readable medium including computer program logic encoded thereon that, when performed on the wearable audio device (e.g., by the processor), causes the device to filter and process signals as described herein. Note that the details of wearable audio device 100 are exemplary of aspects of earphones and are not limiting of the scope of this disclosure, as the present feedforward instability detection can be used in varied types and designs of earbuds and earphones and other wearable audio devices. Also note that aspects of wearable audio device 100 that are not involved in the feedforward instability detection and mitigation are not illustrated in FIG. 3, for the sake of simplicity.

Figure 4A:
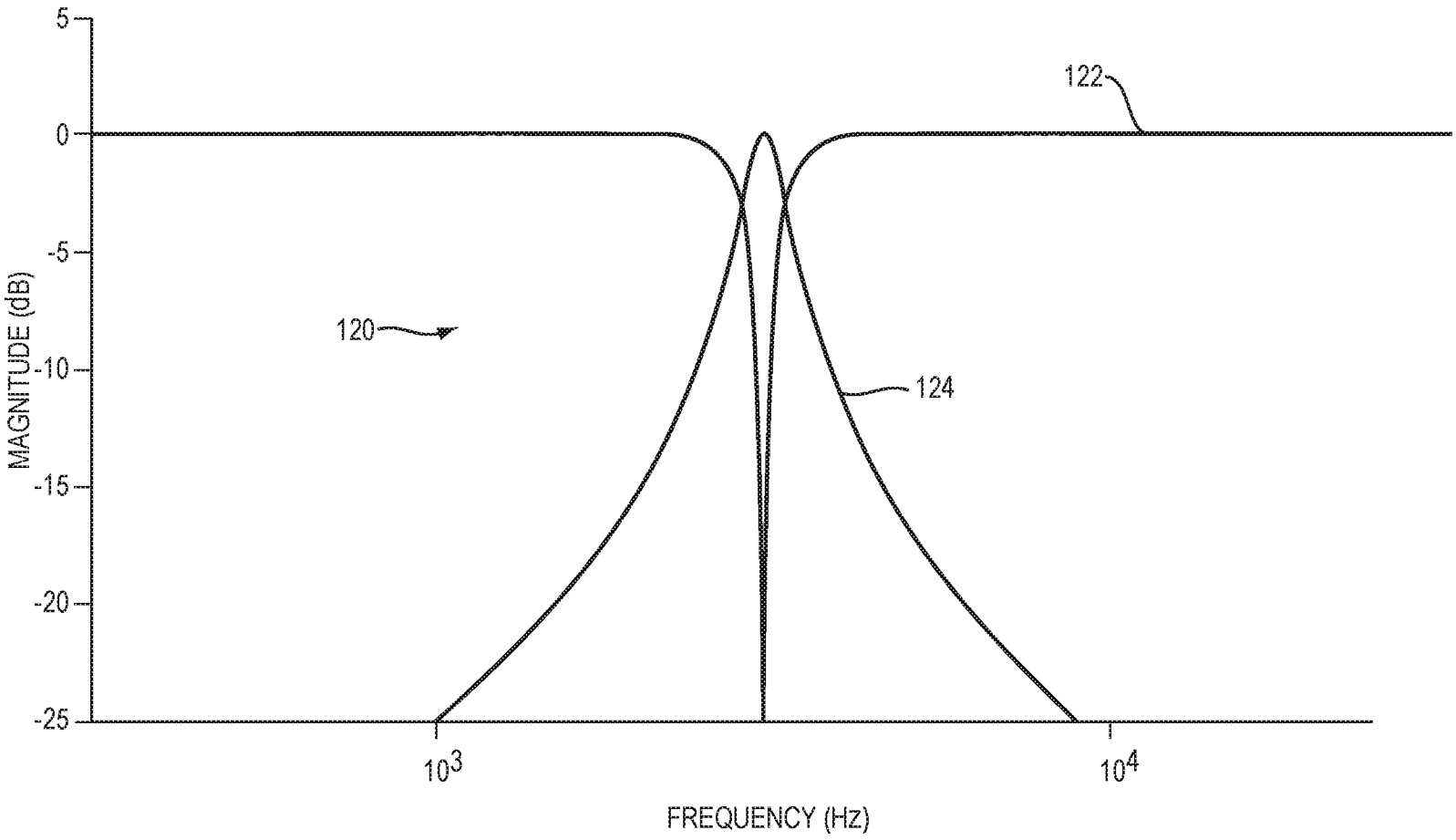
FIGS. 4A, 4B, 4C, and 4D each illustrate filters that are applied to the signal of a feedforward microphone of a wearable audio device.
Figure 4B:
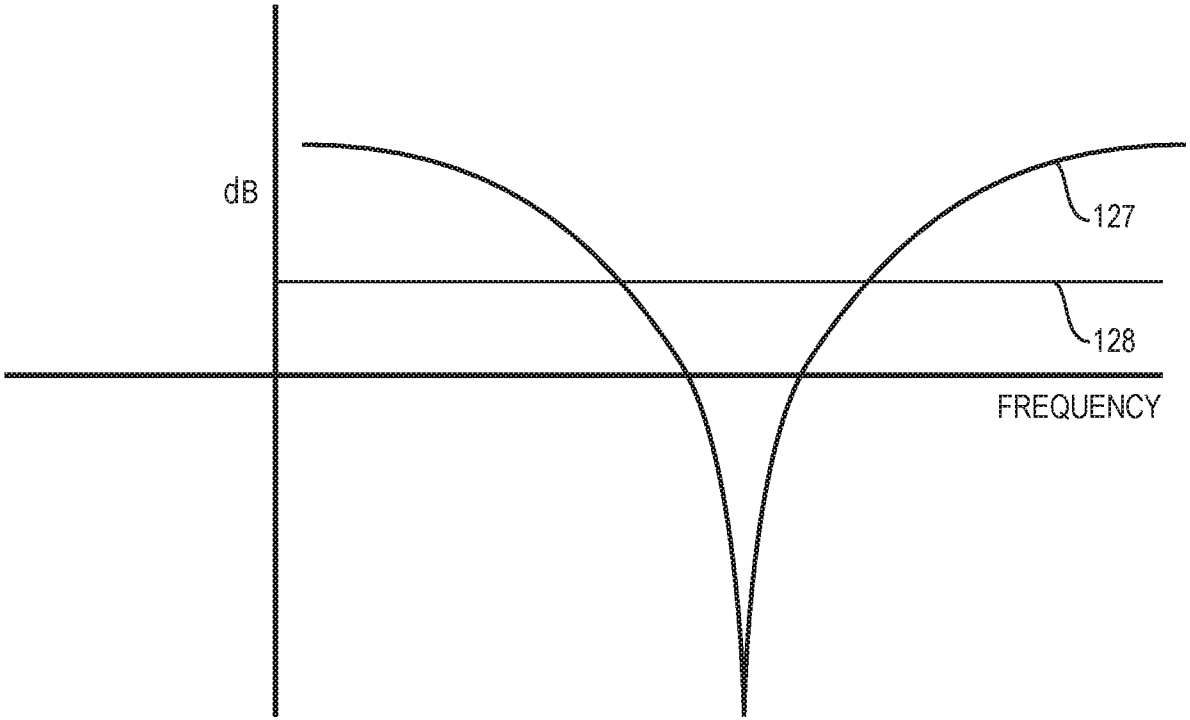
Figure 4C:
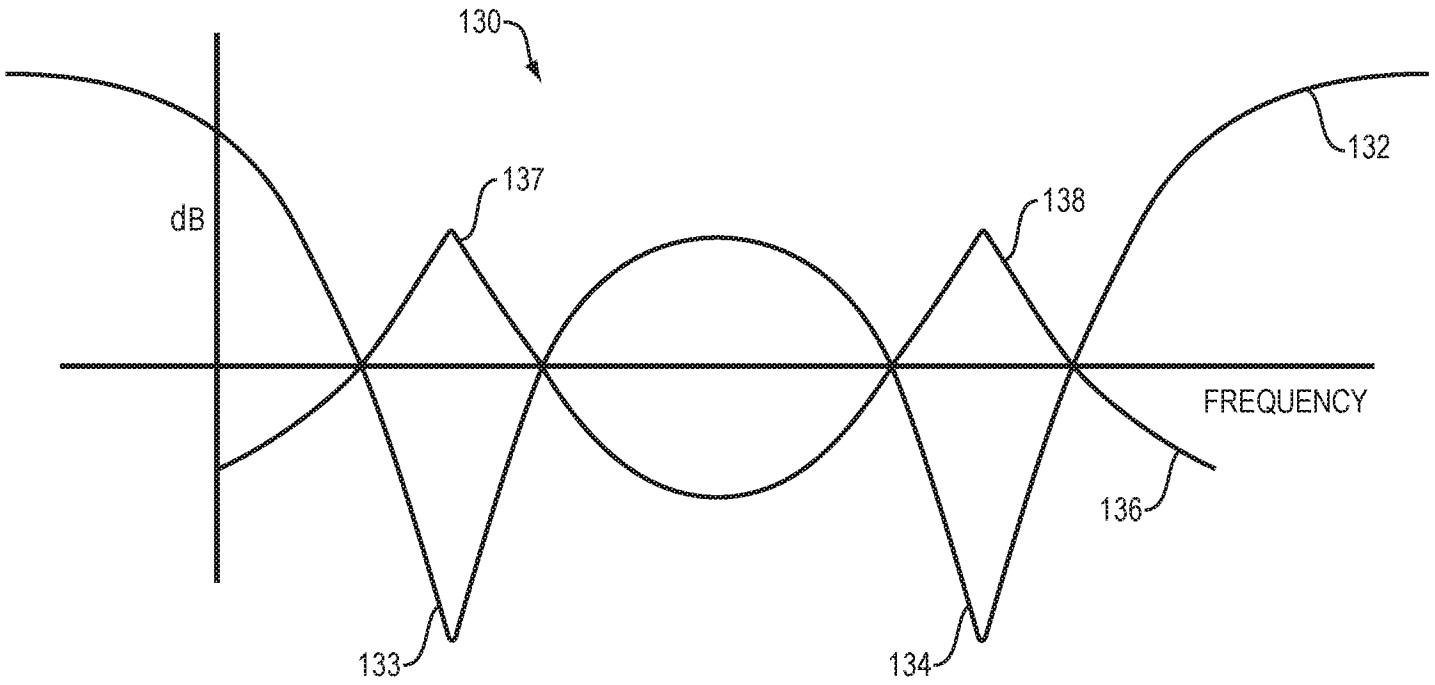
Figure 4D:
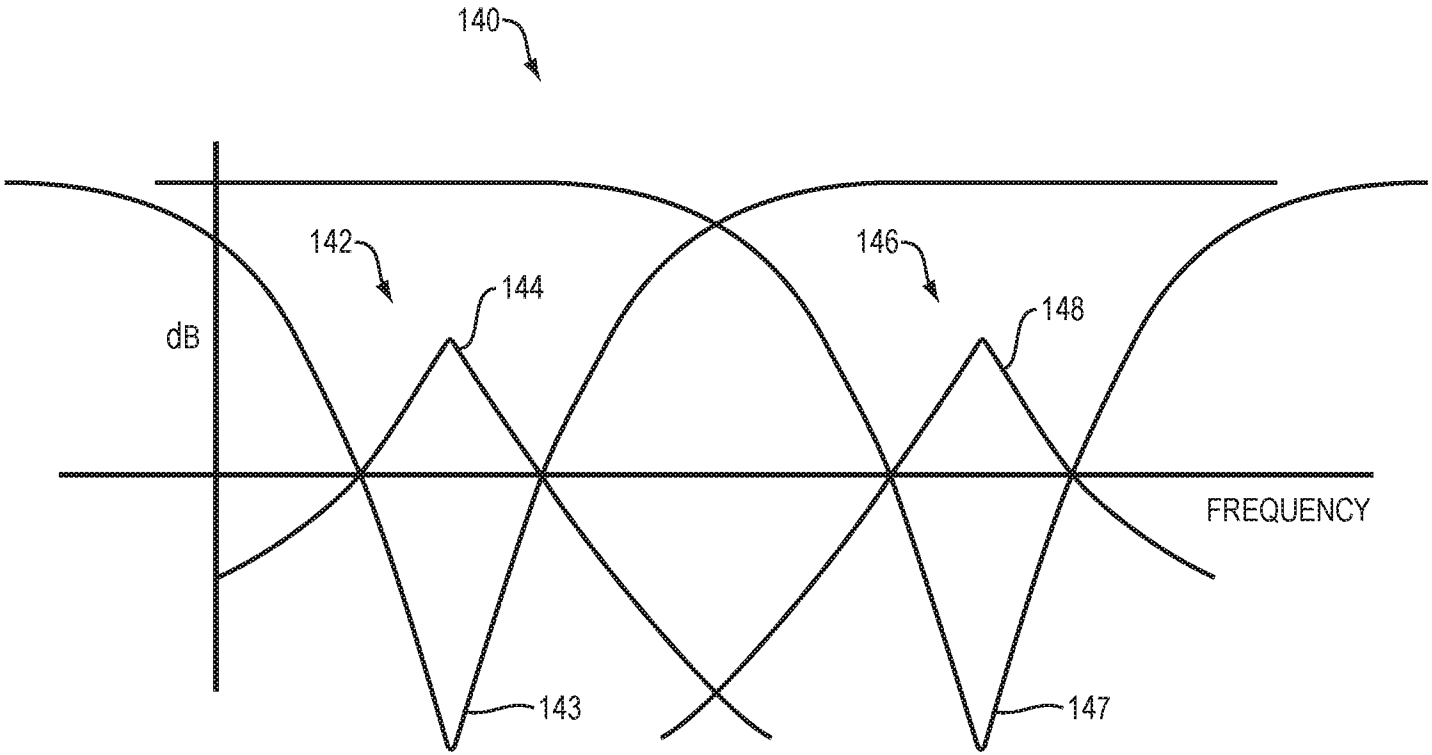

FIG. 4A illustrates exemplary filter set 120 that is applied to the signal of a feedforward microphone of a wearable audio device. In this example filter set 120 includes notch (rejection) filter 122 and peak (detection) filter 124 that are centered at about 3100 Hz in a narrow band of approximately 100 Hz defined by their widths at −3 dB. FIG. 4B illustrates a different set of detection and rejection filters in which detection filter 128 is a gain-only filter and rejection filter 127 is a notch filter. FIG. 4C illustrates filter set 130 with bimodal detection 136 and rejection 132 filters. Bimodal filters would be useful in a system that has two modes where the system can oscillate as a function of acoustic volumes and paths. Detection filter 136 includes peaks 137 and 138 at both of these frequencies, whereas the rejection filter 132 is akin to the inverse, with notches 133 and 134 at these same frequencies. Taking this bimodal example further to multiple detection/rejection filters, each frequency range where the system can oscillate can have its own dedicated filters, a goal of which would be to apply different mitigations depending on the frequency range where the instability was detected. FIG. 4D illustrates an example two-frequency range filter set 140 where first detection/rejection filter set 142 has peak filter 144 and notch filter 143 centered at a first frequency, and second detection/rejection filter set 146 has peak filter 148 and notch filter 147 centered at a second, higher frequency. As depicted, in some examples multiple sets of detection and rejection filters can be used across different frequency bands.

Figure 5:
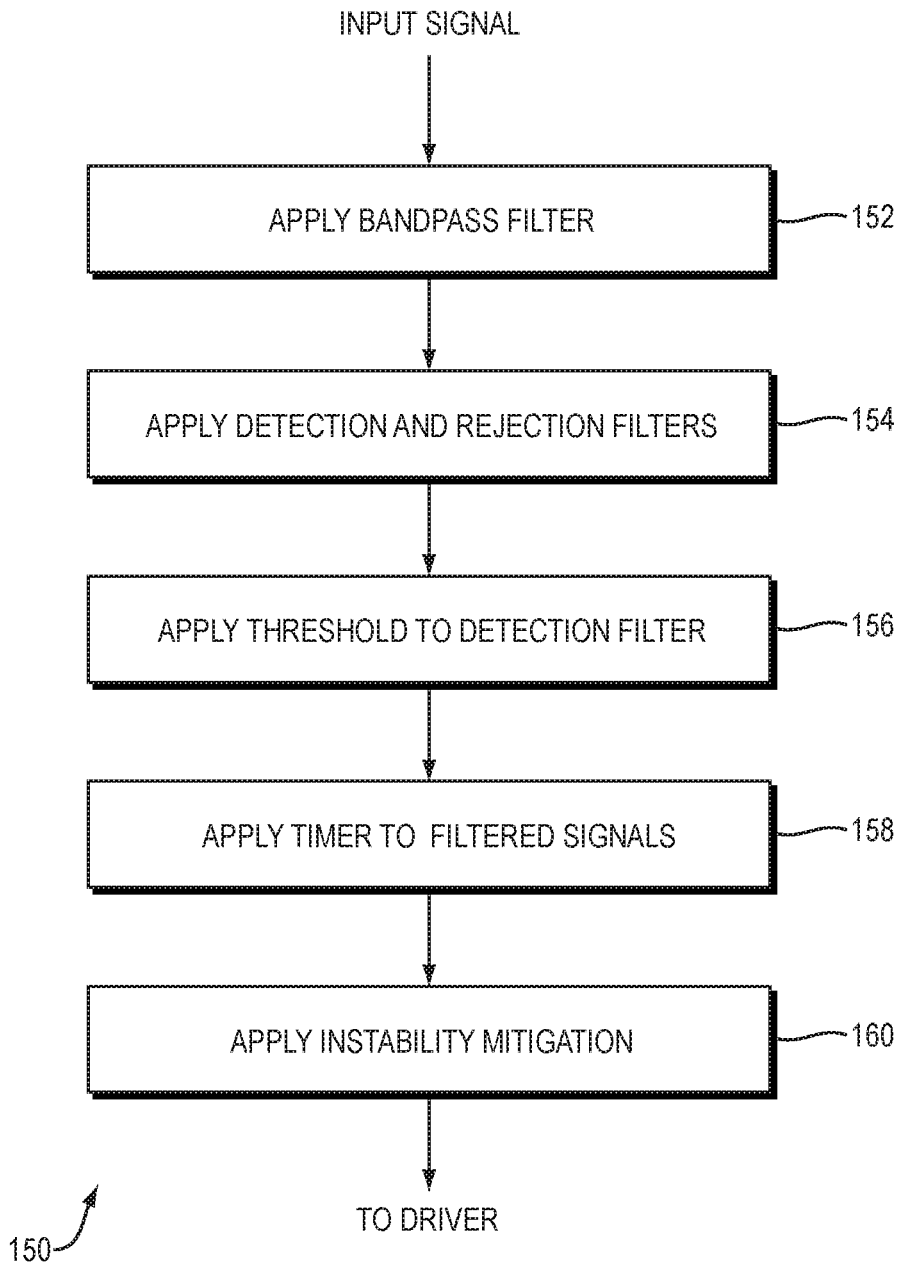
FIG. 5 is a flowchart of an operation of an earbud feedforward instability detection and mitigation methodology.

FIG. 5 is a flowchart of an exemplary operation of an earbud feedforward instability detection and mitigation methodology 150. In an example all steps are performed by the processor. The operations are thus able to be modified as needed simply be properly programming the processor. The input signal is the output of the feedforward microphone. In an optional first step 152 a bandpass filter is applied. In an example the bandpass reduces energy below about 500 Hz and above about 6 kHz. The bandpass decreases the processing that needs to be applied to the signal in the following steps. In step 154 detection and rejection filters are applied, squared, and lowpass smoothing is applied. In an example the filters are accomplished in the time domain, and each sample is smoothed and squared. The detection filter is configured to detect signals in the detection band of at least a predetermined energy. The rejection filter (which is nominally a notch filter) is configured to detect energy outside of the detection band. An objective of the rejection filter is to pass less energy in a band or bands where a signal relative to the detection filter is being looked for. A key to accomplish these objectives is the relative difference from one filter to the other. Step 154 is configured to compare the filtered signal to the signal outside of the detection band and develop a comparison signal that is indicative of feedforward instability in the detection band. In step 156 a threshold is applied to the energy within the peak filter. A threshold is a parameter that can be tuned to balance maximizing detection and minimizing false positives. It is a scalar value. In one respect the threshold helps ensure that quiet tonal signals are not detected as parasitic oscillations. A result of steps 154 and 156 is that an instability is detected only if the peak filtered and squared smoothed signal is above the threshold and the peak filtered signal is greater than the notch filtered squared smoothed signal. Another optional step 158 applies a timer to a logical condition pertaining to the filtered signals (e.g., squared-smoothed detection filter signal greater than squared-smoothed rejection filter signal). This helps avoid detection of transient sounds. A result of steps 154-158 is that an instability is detected only if the peak filtered and squared smoothed signal is above the threshold and the peak filtered signal is greater than the notch filtered squared smoothed signal for at least a minimum duration.

In optional step 160, if an event (i.e., an unwanted parasitic oscillation) is detected, the oscillation is mitigated. A goal is to quickly eliminate oscillations while at the same time not reducing or eliminating desired sounds, even if the mitigation algorithm fires during a false positive event (e.g., an external sound). In an example of step 160, the mitigation involves adjusting a gain that is applied to the signal from the feedforward microphone, before the signal is provided to the driver. In one extreme the entire feedforward gain applied to the feedforward microphone is reduced. However, this can be audible to the user. Typically but not necessarily the gain is reduced in a more controlled manner, to reduce and eliminate the oscillation. In some examples the gain is reduced for a predetermined amount of time and then increased back to its original value. The increase can be over a predetermined time, and can occur gradually over that time. In some examples the adjustment of the gain is frequency dependent. In an example the gain is reduced gradually by about 20 dB, over a period of about 0.5 seconds. In an example the gain is then gradually recovered back to its original value, over about 0.5 seconds. The recovery can take place in a number of steps, so that the user is less likely to detect an anomaly.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

Examples of the systems and methods described herein comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other examples are within the scope of the following claims.

What is claimed is:

1. A system for detecting feedforward instability in a wearable audio device that comprises an electro-acoustic transducer that is configured to develop sound for a user, a housing that holds the transducer, a feedforward microphone that is configured to detect sound outside of the housing and output a microphone signal, and an opening in the housing that emits sound pressure from the transducer that can reach the microphone, the system comprising:

a feedforward instability detector that is configured to:

apply two filters to the microphone signal, wherein a first filter passes more energy in a frequency band than does a second filter, wherein the two filters together are used to develop a filtered signal; and compare the filtered signal to the microphone signal outside of the frequency band, wherein the comparison is used to develop a comparison signal that is indicative of feedforward instability in the frequency band.

2. The system of claim 1 wherein the wearable audio device comprises an earbud that is configured to output sound directly into the user's ear canal.

3. The system of claim 1 wherein the feedforward microphone is used in an active noise reduction (ANR) system.

4. The system of claim 1 wherein the feedforward microphone is used in a transparency mode where environmental sounds are reproduced by the transducer.

5. The system of claim 1 wherein the first filter comprises a peak filter.

6. The system of claim 1 wherein the second filter comprises a notch filter.

7. The system of claim 1 wherein the first and second filters together detect parasitic oscillations in a predetermined frequency range.

8. The system of claim 7 wherein the frequency range is centered at approximately 3,100 Hz.

9. The system of claim 1 wherein the detector is further configured to apply a threshold energy level to the first filter energy.

10. The system of claim 9 wherein feedforward instability is indicated only if the energy level of the energy passed by the first filter is above the threshold.

11. The system of claim 1 wherein feedforward instability is indicated when the energy level of the energy passed by the first filter is greater than the energy level of the energy passed by second filter.

12. The system of claim 11 wherein feedforward instability is indicated when the energy level of the energy passed by the first filter remains greater than the energy level of the energy passed by second filter for at least a threshold amount of time.

13. The system of claim 1 wherein feedforward instability is indicated when the energy level of the energy passed by the first filter is greater than the energy level of the energy passed by the second filter and the microphone signal outside of the frequency band is greater than a signal level threshold, for at least a threshold amount of time.

14. The system of claim 1 further comprising an instability mitigator that is configured to adjust a gain applied to the microphone signal.

15. The system of claim 14 wherein the gain is reduced for a predetermined amount of time.

16. The system of claim 15 wherein after the predetermined amount of time the gain is increased back to its original value.

17. The system of claim 16 wherein the increase in gain occurs gradually over a predetermined period of time.

18. The system of claim 14 wherein the gain is adjusted in a frequency-dependent manner.

19. The system of claim 1 wherein the feedforward instability detector is configured to apply multiple sets of detection and rejection filters at different frequency bands.

20. A computer program product having a non-transitory computer-readable medium including computer program logic encoded thereon that, when performed on a wearable audio device that comprises an electro-acoustic transducer that is configured to develop sound for a user, a housing that holds the transducer, a feedforward microphone that is configured to detect sound outside of the housing and output a microphone signal, and an opening in the housing that emits sound pressure from the transducer that can reach the microphone, causes the wearable audio device to:

apply two filters to the microphone signal, wherein a first filter passes more energy in a frequency band than does a second filter, wherein the two filters together are used to develop a filtered signal; and compare the filtered signal to the microphone signal outside of the frequency band, wherein the comparison is used to develop a comparison signal that is indicative of feedforward instability in the frequency band.

21. The computer program product of claim 20 wherein the wearable audio device comprises an earbud that is configured to output sound directly into the user's ear canal.

* * * * *